US006363536B1

(12) United States Patent
Sloan

(10) Patent No.: US 6,363,536 B1
(45) Date of Patent: Apr. 2, 2002

(54) GARMENT ACCESSORY

(76) Inventor: Emma Lee Sloan, 102 Elm St., Cahokia, IL (US) 62206

( * ) Notice: Subject to any disclaimer, the term of this patent is extended or adjusted under 35 U.S.C. 154(b) by 0 days.

(21) Appl. No.: 09/474,629

(22) Filed: Dec. 29, 1999

(51) Int. Cl.[7] ..... A41D 19/00
(52) U.S. Cl. ..... 2/163; 2/59
(58) Field of Search ..... 2/16, 159, 163, 2/160, 161.6, 161.1, 167, 249, 250, 251, 125, 126, 59

(56) References Cited

U.S. PATENT DOCUMENTS

| | | | | |
|---|---|---|---|---|
| D39,609 | S | | 10/1908 | Richards |
| 1,691,445 | A | | 11/1928 | Meliodon |
| D114,392 | S | | 4/1939 | Dunton |
| 2,239,998 | A | | 4/1941 | Fellegi et al. |
| D221,411 | S | | 8/1971 | Cook |
| 3,701,166 | A | | 10/1972 | Lindblom |
| D226,744 | S | | 4/1973 | Chaffin |
| D228,160 | S | | 8/1973 | Harrison |
| 3,837,007 | A | | 9/1974 | Girest |
| 4,757,558 | A | | 7/1988 | Strongwater |
| 4,785,478 | A | * | 11/1988 | Mosley ..... 2/161 |
| D298,869 | S | | 12/1988 | Thomas |
| 4,881,275 | A | * | 11/1989 | Cazares et al. ..... 2/161 |
| 5,010,589 | A | | 4/1991 | Hamilton |
| 5,022,093 | A | * | 6/1991 | Hall ..... 2/158 |
| D359,380 | S | | 6/1995 | O'Guinn |
| 5,858,054 | A | * | 1/1999 | Rosen ..... 66/202 |
| D405,587 | S | | 2/1999 | Merikoski |
| 5,918,315 | A | | 7/1999 | Trachtenberg |

* cited by examiner

*Primary Examiner*—John J. Calvert
*Assistant Examiner*—Katherine Moran
(74) *Attorney, Agent, or Firm*—Greensfelder, Hemker & Gale, P.C.

(57) ABSTRACT

The present invention involves a garment accessory that provides unrestricted access to certain fingers of a hand while also providing a covering such that the fingers to be accessed remain purposefully covered. The garment accessory is primarily constructed of a series of spaced apart elastic rings which fit around the arm of a wearer, a series of longitudinal strips having taffeta or a decorative covering stitched thereto wherein the longitudinal strips are fastened to the elastic rings, sheaths for receiving the middle finger, thumb and pinky finger, and two slots for receiving the ring finger and forefinger. During a marriage ceremony, for example, the bride is not required to remove the garment accessory for the ring portion of the ceremony as would be required with a conventional decorative glove, thereby facilitating a more efficient and convenient ceremony. The garment accessory can be configured for access to any desired finger or series of fingers, and can be constructed for attachment to a variety of locations along the arms, hands and/or fingers.

15 Claims, 6 Drawing Sheets

GARMENT ACCESSORY

BACKGROUND OF THE INVENTION

1. Field of the Invention

The present invention relates to the field of garment accessories and in particular bridal accessories used to fashionably cover the arms, hands, and/or fingers of the wearer. More specifically, the field of the invention involves garment accessories wherein access to certain fingers of the wearer is desirable during the time that the garment accessory is being worn.

2. Description of Related Art

Methods and devices for garment accessories covering the arms, hands, and/or fingers of a wearer are numerous and well known in the art and are used in a variety of applications including but not limited to fashion, safety, sporting, and protective coverings. Generally, the coverings provide some added measure of functionality such as a reflective property for safety coverings, or a decorative property for fashion coverings, while being attached either directly to the wearer, or to the general garment of the wearer.

Fashion coverings such as those used as bridal accessories are generally in the form of a glove that completely cover the fingers and hand of the wearer and further traverse a portion of the arm. Without some means for access to the ring finger, the glove must be removed for placement of the ring during a wedding ceremony. Known art bridal accessory gloves that do provide access to the ring finger, such as the glove disclosed in Strongwater U.S. Pat. No. 4,757,558 or O'Guinn U.S. Pat. No. D 359,380, generally have the sheath for the ring finger completely removed, thereby leaving the entire ring finger uncovered. Other known garment accessories provide a covering, such as the sleeve disclosed in Merikoski U.S. Pat. No. D 405,587 or Thomas U.S. Pat. No. D 298,869, for the arms and a portion of the hand while leaving most of or all of the fingers exposed for subsequent access. The known art garment accessories that provide access to the fingers, however, leave the fingers uncovered and thereby detract from the overall fashion appearance.

Other known garment accessories that are attached to a wearer are generally sleeves that cover only the arm, or the arm and a portion of the hand. The sleeves are either worn together with a garment or are directly attached to the arm of the wearer, and provide various functions including fashion coverings such as Trachtenberg U.S. Pat. No. 5,918,315, reflective sleeves for safety such as Girest U.S. Pat. No. 3,837,007, and camouflage accessories for sporting activities such as Hamilton U.S. Pat. No. 5,010,589. The known garment accessories in the form of sleeves that provide access to the fingers, however, do not provide a covering for all of the fingers.

A critical limitation in the known art is the inability to provide unrestricted access to the fingers while at the same time substantially covering the fingers for an intended purpose such as a fashion covering. Furthermore, the known art requires the often awkward and cumbersome removal of the garment accessory, i.e. removal of a glove, to gain the required access to the fingers of the wearer.

A dual-purpose garment accessory is needed which is capable of providing a purposeful covering while maintaining unrestricted access to one or more fingers of the wearer without removal of the accessory. The garment accessory should also be comfortable to the wearer and simple to attach and remove.

SUMMARY OF THE INVENTION

The present invention overcomes the limitations of the prior art by providing a garment accessory that provides unrestricted access to the fingers of a wearer while also providing a purposeful covering. The garment accessory is a detachable sleeve that includes spaced apart elastic rings, longitudinal strips, finger retainers, and a covering. The longitudinal strips are attached to both the finger retainers and to a series of spaced apart elastic rings wherein the elastic rings are placed around the arm of the wearer. A purposeful covering such as a fashionable taffeta is attached over the top of the longitudinal strips. The finger retainers include slots for receiving the fingers that are to remain accessible and sheaths for receiving the fingers which are not accessible during subsequent use. The slots are created by interconnecting the covering between adjacent sheaths at the finger portion of the garment accessory. The cover, therefore, has both decorative and structural functionality. It shall be understood that the covering can serve many purposes including but not limited to fashion, safety, sporting, and protective coverings where unrestricted access to the fingers is desired. For example, access to certain fingers while hunting, such as the trigger finger, may be desired while maintaining a complete covering of the hands and fingers for protection from the elements or as camouflage. Furthermore, the garment accessory can be attached to a mannequin or other like equipment in addition to the arm of a person.

To attach the garment accessory, the wearer first slides a hand through the elastic rings and then progressively slides the arm through the elastic rings wherein the elastic rings traverse the arm in an upward direction. The elastic rings thereby secure the garment accessory to the arm of the wearer. The fingers are then slidably engaged with the series of finger retainers and depending on the finger(s) requiring access, certain fingers will engage a sheath and other fingers will engage a slot. The sheaths are used for fingers that do not require access and cover the end of the fingers. The slots are used for fingers that do require access and secure the fingers within the accessory without restricting access to the fingers. For example, to provide access to the ring finger during a wedding ceremony, each of the thumb, middle finger, and pinky slidably engage a sheath, and each of the ring finger and forefinger slidably engage a slot. As the decorative covering is attached to the longitudinal strips and the longitudinal strips are attached in part to the series of finger retainers, the fingers of the wearer appear to be completely covered. Because the ring finger and forefinger are inserted through a slot created by the interconnected covering, unrestricted access to the ring finger and forefinger remains. Furthermore, the decorative covering as a whole covers the arm and the hand, in addition to the fingers.

With the garment accessory attached during a wedding ceremony, the wearer is not required to remove the accessory for placement of the ring on the ring finger, thereby facilitating a more efficient and convenient ceremony while reducing the opportunity for nervous mishaps. With conventional garment accessories that completely cover the hand and fingers, the accessory must be removed for the ring portion of the ceremony, thereby creating a disruption and an inconvenience for the wearer and other participants. The present invention eliminates the need to remove the garment accessory for access to the finger while at the same time providing a fashionable means to completely cover the hand and fingers of the wearer. The garment accessory, therefore, provides unrestricted access to the desired finger(s) while maintaining a purposeful covering. Furthermore, the present invention is easy to attach and remove and is comfortable to the wearer.

Other objects and features will be apparent or are pointed out more particular herein below.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
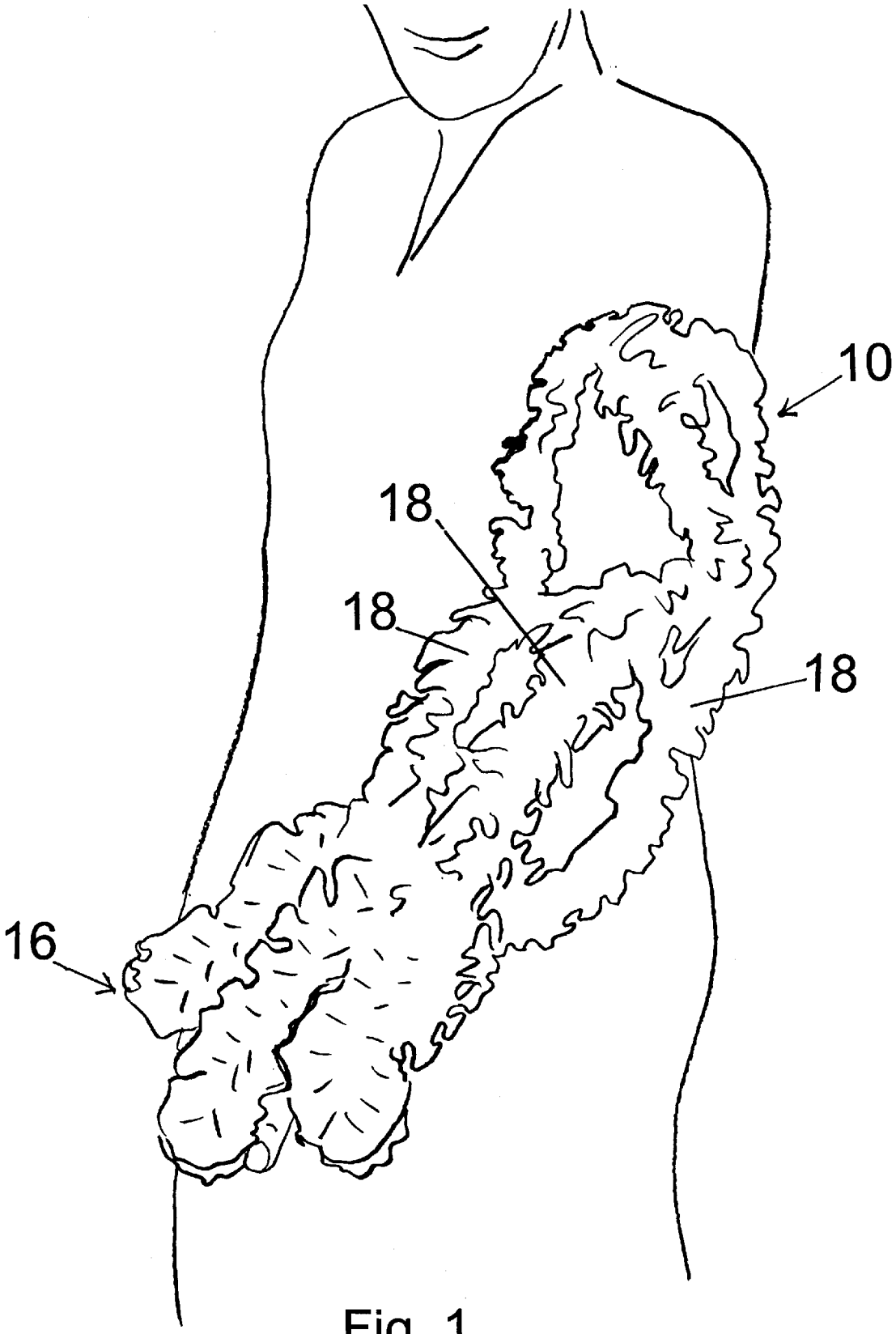
FIG. 1 is a perspective view of the garment accessory attached to a wearer.

Reference characters throughout the several views indicate corresponding parts of the invention. Although the drawings represent embodiments of the present invention, the drawings are not necessarily to scale and certain features may be exaggerated in order to better illustrate and explain the present invention. The description set out herein illustrates an embodiment of the invention, in one form, and such descriptions are not to be construed as limiting the scope of the invention in any manner.

DESCRIPTION OF THE PRESENT INVENTION

Figure 2:
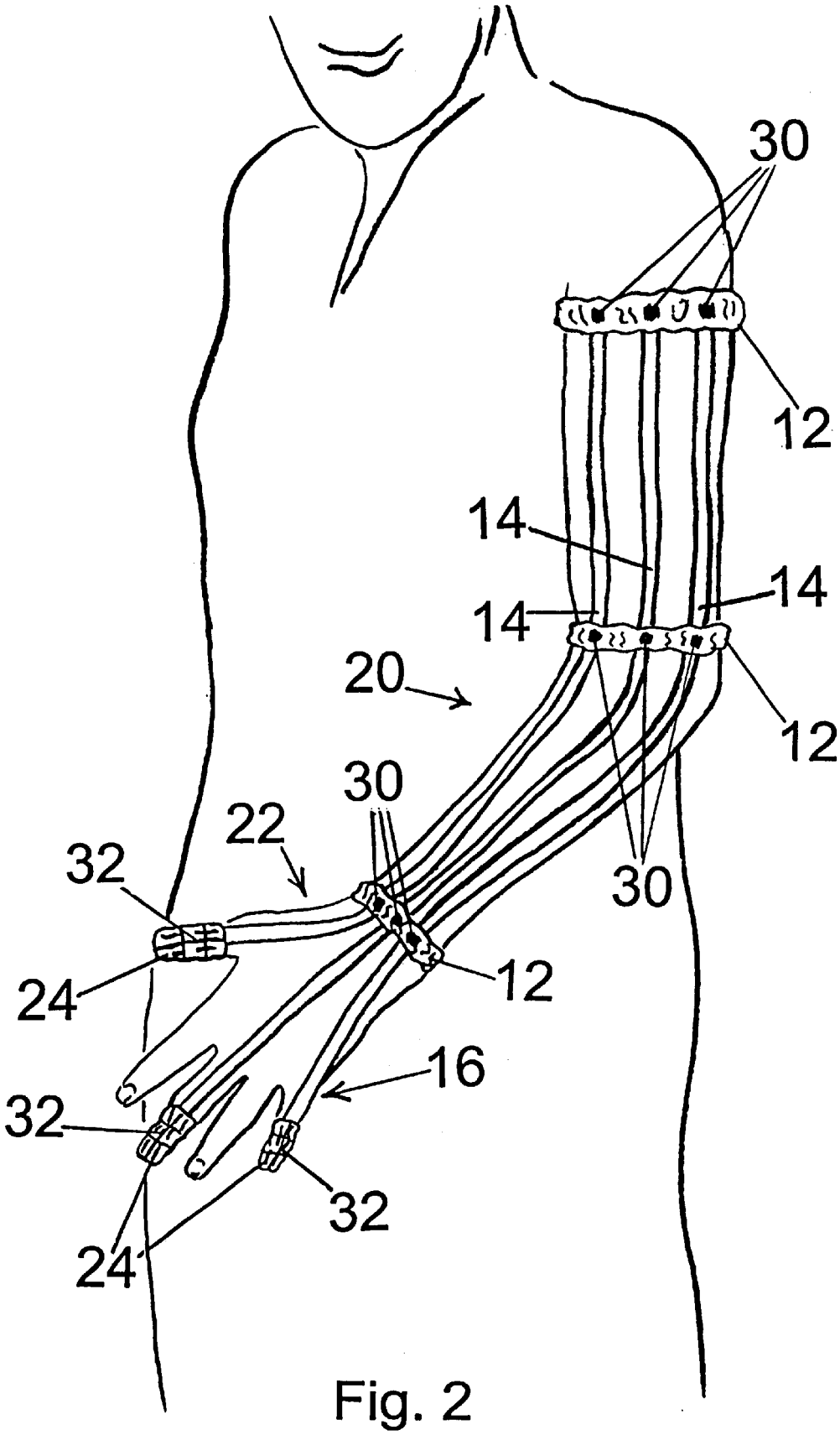
FIG. 2 is a perspective view of the garment accessory attached to a wearer with the covering removed.

Referring to the drawings, as illustrated in FIG. 1, garment accessory 10 is attached to a wearer wherein the accessory fashionably covers the arm, hand, and fingers of the wearer. As best shown in FIG. 2, garment accessory 10 includes a series of elastic rings 12 attached to the arm of a wearer, a series of longitudinal strips 14 attached to elastic rings 12, and a plurality of finger retainers 16. Finger retainers 16 are shown in both FIG. 1 and FIG. 2 and are further described in the following. Covering strips 18 are attached to longitudinal strips 14 as best shown in FIG. 1, and are not shown in FIG. 2 for clarity. Longitudinal strips 14 include arm portion 20 and finger portion 22.

Figure 3:
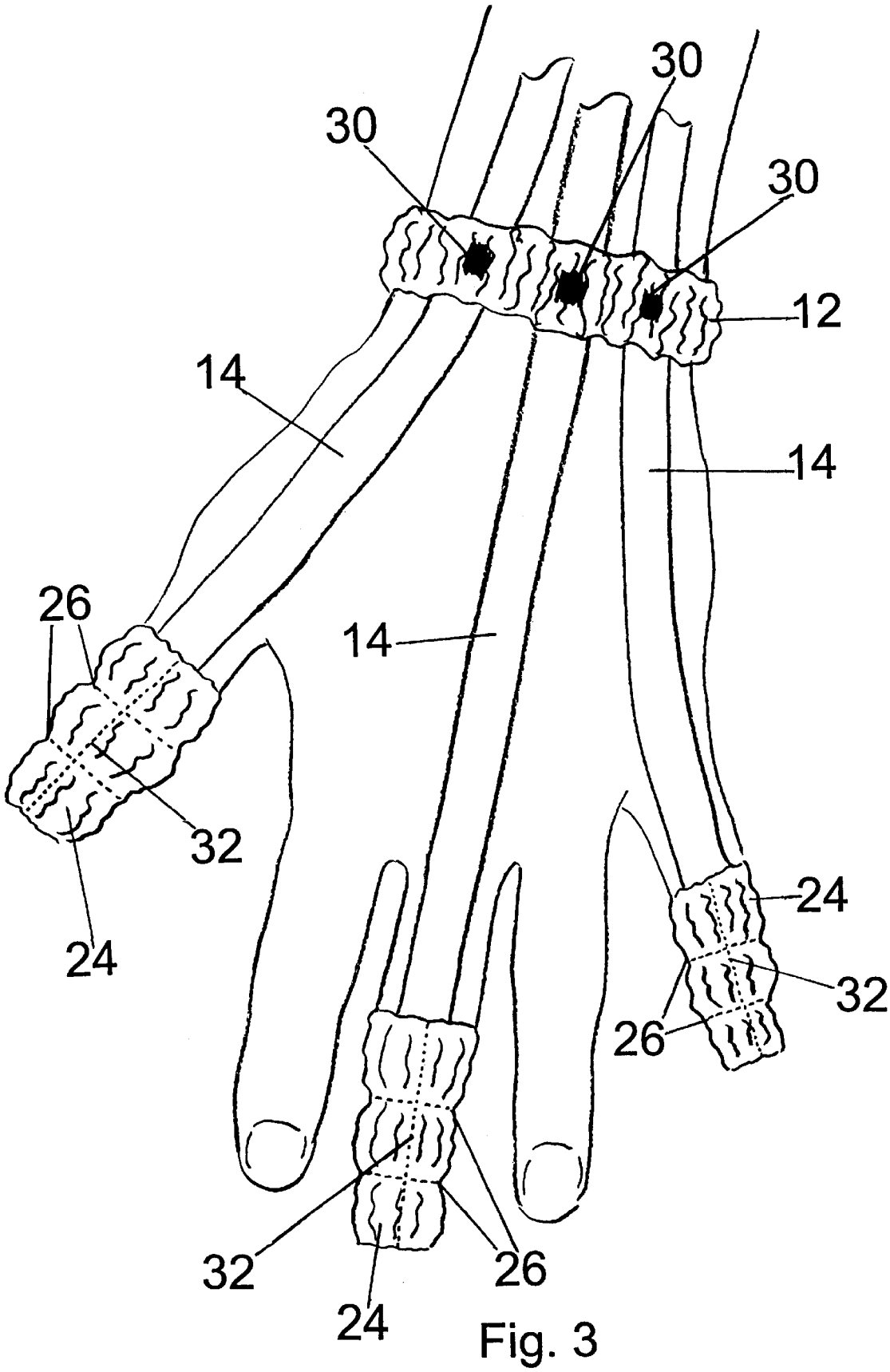
FIG. 3 is a top view of the hand and finger portion of the garment accessory attached to a wearer with the covering removed.
Figure 4:
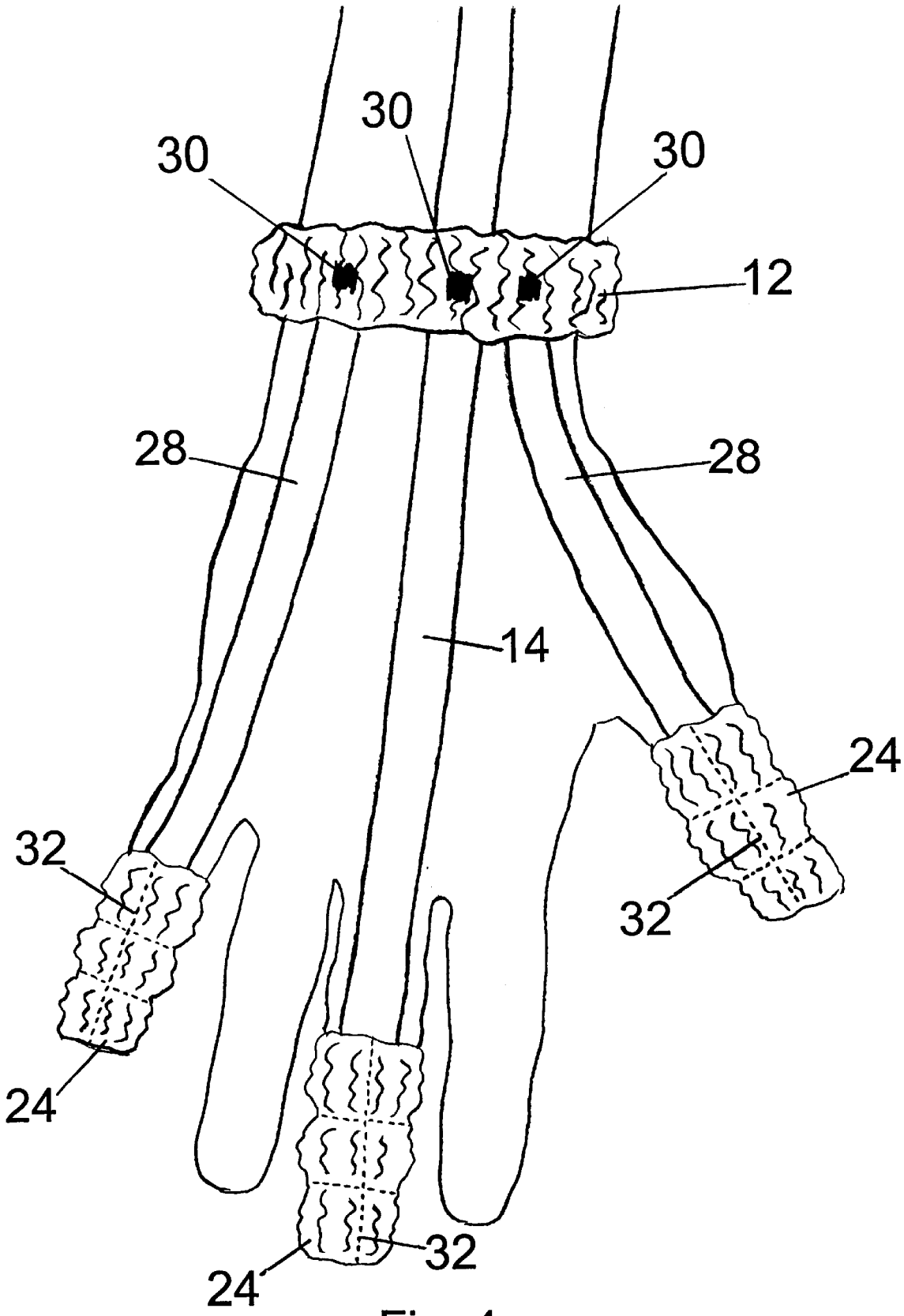
FIG. 4 is a bottom view the hand and finger portion of the garment accessory attached to a wearer with the covering removed.

As shown in FIG. 3, finger retainers 16 include finger sheaths 24 that are attached to longitudinal strips 14. Finger sheaths 24 further include radial stitching 26 for improved securing of garment accessory 10 to the fingers of a wearer. Longitudinal strips 14 traverse the entire length of the fingers, hand, and arm on the top side of garment accessory 10. As shown in FIG. 4, however, only one longitudinal strip 14 traverses the entire length on the under side of garment accessory 10, and adjacent longitudinal strips 28 traverse only the finger and hand of a wearer and are terminated at elastic ring 12.

As shown in FIG. 2, elastic rings 12 are preferably sewn to arm portion 20 of longitudinal strips 14 at tacks 30. Finger sheaths 24 are preferably sewn to finger portion 22 of longitudinal strips 14 at seams 32. Similarly, as shown in FIG. 4, adjacent longitudinal strips 28 on the under side of garment accessory 10 are preferably sewn to first elastic ring 12 at tacks 30 and similarly to finger sheaths 24 at seams 32. As shown in FIG. 1, covering strips 18 are also preferably sewn to both arm portion 20 and finger portion 22 of longitudinal strips 14 thereby covering the entire length of longitudinal strips 14.

Figure 5:
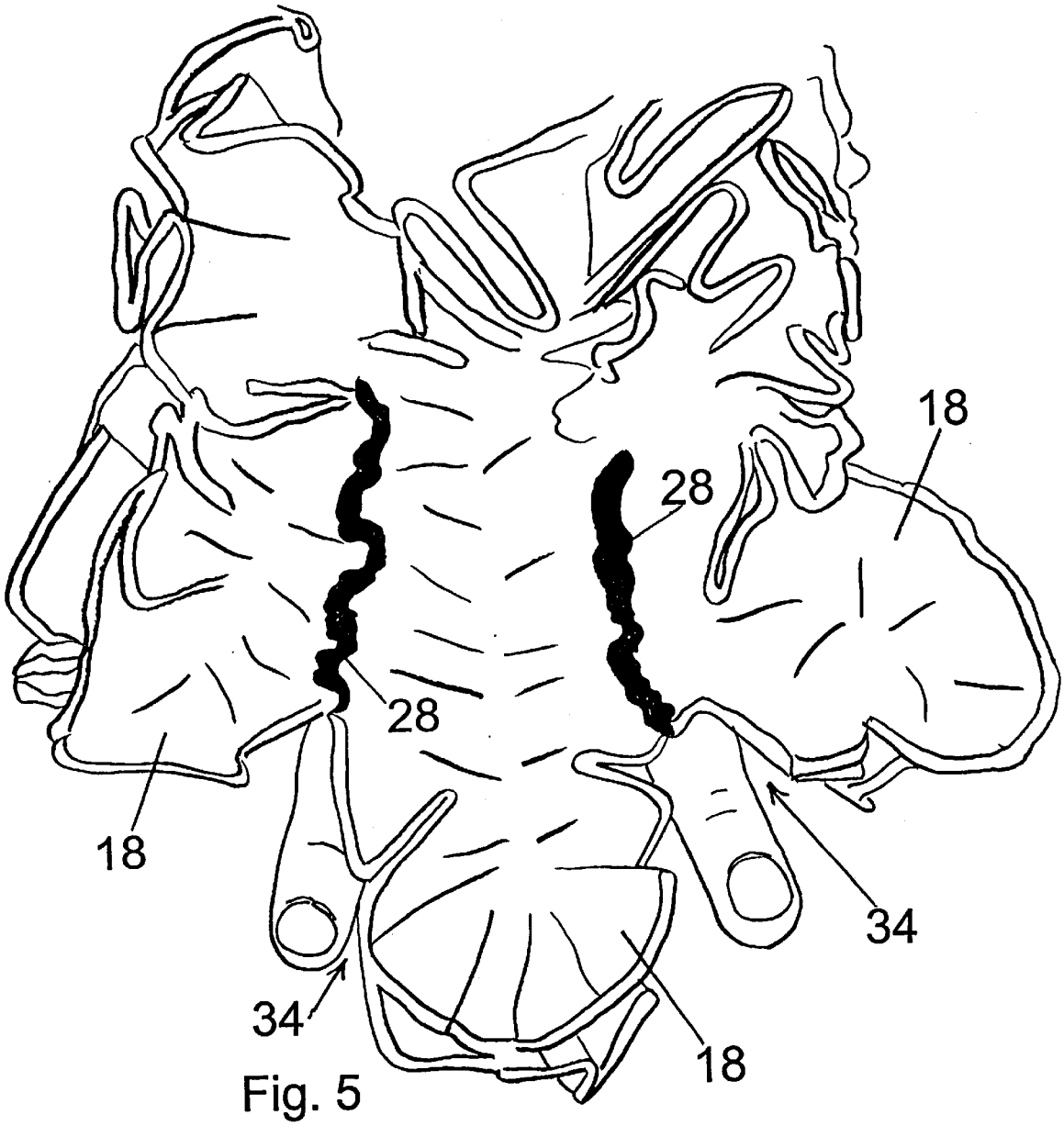
FIG. 5 is a top view of the hand and finger portion of the garment accessory attached to a wearer with the fingers spread apart.
Figure 6:
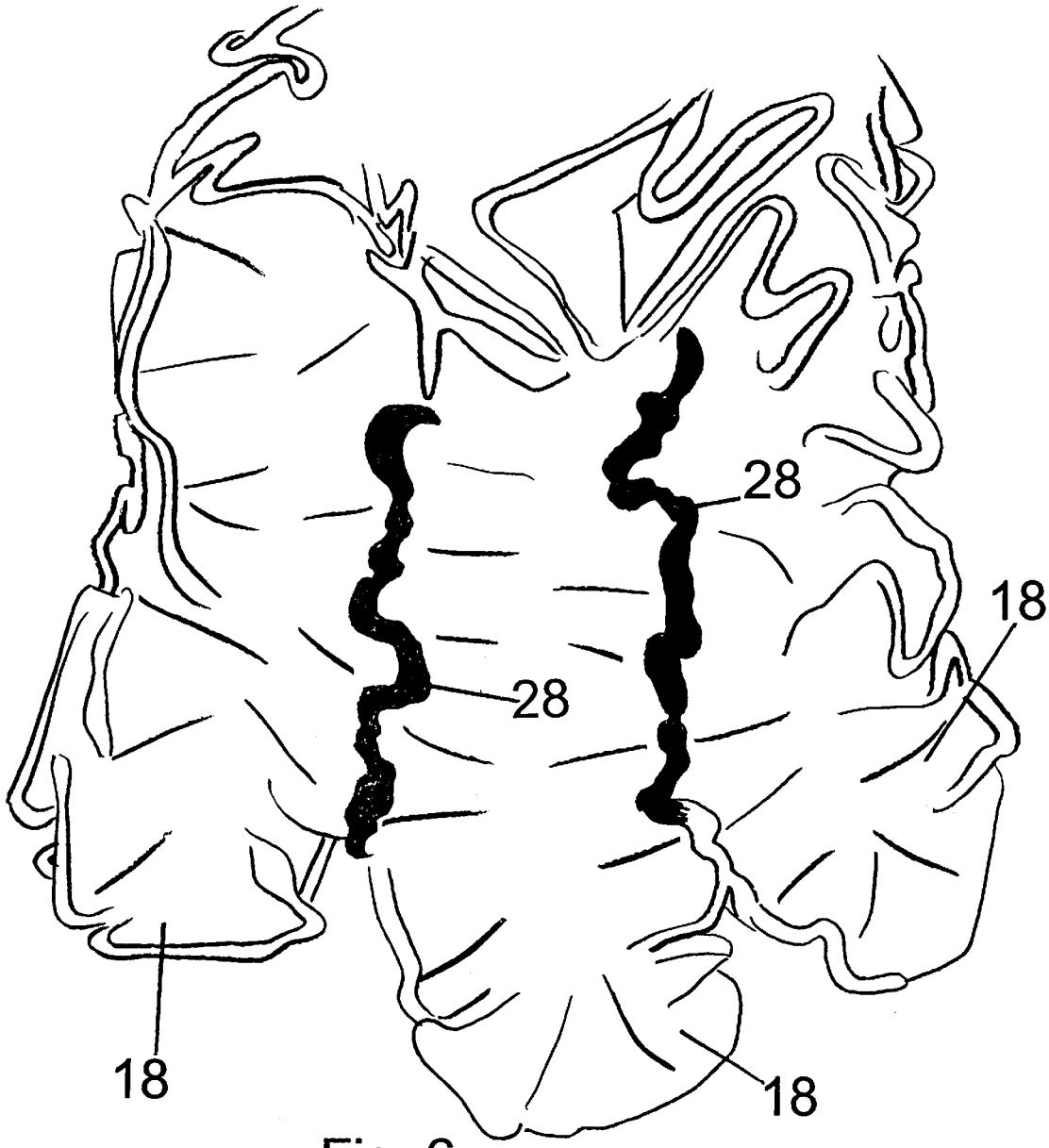
FIG. 6 is a top view of the hand and finger portion of the garment accessory attached to a wearer with the fingers in a relaxed position.

As shown in FIG. 5, finger retainers 16 also include finger slots 34. Finger slots 34 are created by interconnecting covering strips 18 between adjacent finger sheaths at finger portion 22 of longitudinal strip 14 by seams 28. By interconnecting covering strips 18 at seams 28, finger slot 34 is created in the space between adjacent finger sheaths 24 wherein fingers that require unrestricted access are inserted and can protrude. As shown in FIG. 6, the ring finger and forefinger remain completely covered by covering strips 18 and yet are still accessible, for example, to place a ring upon the ring finger.

To attach garment accessory 10, a wearer progressively inserts a hand and then the arm through elastic rings 12 and pulls garment accessory 10 upwards along the arm. The fingers of the wearer are then slidably engaged with finger retainers 16 whereby the fingers that require access are inserted through finger slots 34 and the fingers that do not require access are inserted into finger sheaths 24. As shown in FIG. 6, covering strips 18 completely cover the hand and fingers of the wearer and yet the fingers inserted through finger slots 34 are accessible without removing garment accessory 10.

The materials that comprise garment accessory 10 are generally comfortable, durable, and washable. Covering strips 18 are preferably a decorative taffeta material, longitudinal strips 14 are preferably a silk or polyester blend material, and elastic rings 12 are preferably nylon elastic band covered with a silk or polyester blend material. Finger sheaths 24 are similarly a silk or polyester blend material.

In view of the foregoing description of the present invention and practical embodiments it will be seen that the several objects of the invention are achieved and other advantages are attained. The embodiments and examples were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting.

The breadth and scope of the present invention should not be limited by any of the above-described exemplary embodiments, but should be defined only in accordance with claims of the application and their equivalents.

What is claimed is:

1. A garment accessory for access to at least one finger of a wearer whereby the fingers of the wearer remain covered, said garment accessory comprising:

a plurality of finger retainers;

a covering;

an attachment means having a plurality of elastic rings and a plurality of longitudinal strips, wherein said longitudinal strips have an arm portion and a finger portion, said arm portion being fixably attached to said elastic rings, said finger portion being fixably attached to said plurality of finger retainers, and said covering being fixably attached to said plurality of longitudinal strips, wherein said covering is fixably attached to said attachment means, said attachment means is fixably attached to said plurality of finger retainers, said plurality of finger retainers being slidably engaged by the fingers of the wearer, and said attachment means engaging the body of the wearer.

2. The garment accessory of claim 1 wherein said plurality of finger retainers further comprise:

at least one finger slot; and a plurality of finger sheaths, wherein said finger slot is disposed between said plurality of finger sheaths, said plurality of finger sheaths being fixably attached to said finger portion of said longitudinal strips, and said finger slot being created by said covering being fixably attached to said plurality of longitudinal strips.

3. The garment accessory of claim 1 wherein said plurality of finger retainers further comprise:

at least one finger slot; and a plurality of finger sheaths, wherein said finger slot is disposed between said plurality of finger sheaths, said plurality of finger sheaths being fixably attached to said attachment means, and said finger slot being created by said covering being fixably attached to said attachment means.

4. The garment accessory as in claim 2 or 3 wherein said finger sheaths further comprise a plurality of radial stitches for securing said finger sheaths to the fingers of the wearer.

5. The garment accessory of claim 2 wherein said covering is made of a taffeta material.

6. The garment accessory of claim 5 wherein said taffeta covering is further comprised of a plurality of covering strips, said covering strips being correspondingly attached to said plurality of longitudinal strips, and said plurality of covering strips being fixably interconnected near said finger portion of said longitudinal strips, and said finger slot being created by said plurality of covering strips being fixably interconnected near said finger portion of said longitudinal strips.

7. The garment accessory of claim 1 wherein said covering is made of a taffeta material.

8. A method permitting a person to wear a garment accessory without the need to remove the garment accessory for access to at least one finger of a wearer comprising the steps:

(a) providing a garment accessory having a plurality of finger retainers, a covering, and an attachment means having a plurality of elastic rings and a plurality of longitudinal strips, wherein said longitudinal strips have an arm portion and a finger portion, said arm portion fixably attached to said elastic rings, said finger portion fixably attached to said plurality of finger retainers, and said covering fixably attached to said plurality of longitudinal strips;

(b) slidably engaging said attachment means over the hand of the wearer and then over the arm of the wearer;

(c) slidably engaging the fingers of the wearer through said plurality of finger retainers; and (d) wearing said garment accessory such that the fingers of the wearer are accessible and covered by said covering.

9. The method of claim 8 wherein said plurality of finger retainers further comprise:

at least one finger slot; and a plurality of finger sheaths, wherein said finger slot is disposed between said plurality of finger sheaths, said plurality of finger sheaths being fixably attached to said finger portion of said longitudinal strips, and said finger slot being created by said covering being fixably attached to said plurality of longitudinal strips.

10. The method of claim 8 wherein said plurality of finger retainers further comprise:

at least one finger slot; and a plurality of finger sheaths, wherein said finger slot is disposed between said plurality of finger sheaths, said plurality of finger sheaths being fixably attached to said attachment means, and said finger slot being created by said covering being fixably attached to said attachment means.

11. The method of claim 9 wherein the step of slidably engaging the fingers of the wearer through said plurality of finger retainers further comprises the steps of:

(a) slidably engaging the thumb, middle finger, and pinky with said finger sheaths; and (b) slidably engaging the ring finger and forefinger through said finger slots.

12. The method as in claim 9 or 10 wherein said finger sheaths further comprise a plurality of radial stitches for securing said finger sheaths to the fingers of the wearer.

13. The method of claim 9 wherein said covering is made of a taffeta material.

14. The method of claim 13 wherein said taffeta covering is further comprised of a plurality of covering strips, said plurality of covering strips being correspondingly attached to said plurality of longitudinal strips, and said plurality of covering strips being fixably interconnected near said lower end of said longitudinal strips, and said finger slot being created by said plurality of covering strips being fixably interconnected near said finger portion of said longitudinal strips.

15. The method of claim 8 wherein said covering is made of a taffeta material.

* * * * *